United States Patent [19]

Stern et al.

[11] Patent Number: 4,564,000

[45] Date of Patent: Jan. 14, 1986

[54] PRECISION CUTTING OF MILLIMETER WAVE FERRITE MATERIALS

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 628,553

[22] Filed: Jul. 6, 1984

[51] Int. Cl.[4] ..... B28D 1/04

[52] U.S. Cl. ..... 125/13 R; 51/283 R

[58] Field of Search ..... 125/13 R, 15; 51/206 R, 51/283 R

[56] References Cited

U.S. PATENT DOCUMENTS

| | | | |
|---|---|---|---|
| 2,691,858 | 10/1954 | Andrus | 125/13 R |
| 4,016,855 | 4/1977 | Mimata | 125/13 R |
| 4,067,311 | 1/1978 | Benetello | 125/13 R |
| 4,167,174 | 9/1979 | Hampton | 125/13 R |

*Primary Examiner*—Harold D. Whitehead

*Attorney, Agent, or Firm*—Anthony T. Lane; Jeremiah G. Murray; John T. Rehberg

[57] ABSTRACT

Ferrite material to be used in millimeter wavelength apparatus is sawed using a resin bonded diamond sawblade. A cutting speed of 5400 cm/sec is achieved by appropriate selection of sawblade diameter and spindle speed, such as 5.71 cm and 18,000 RPM. With this cutting speed and sawblade material a cut up to a maximum of 0.356 cm is possible while the ferrite is fed at from 0.0254 to 0.127 cm/sec.

7 Claims, 2 Drawing Figures

PRECISION CUTTING OF MILLIMETER WAVE FERRITE MATERIALS

The invention described herein may be manufactured, used and licensed by or for the Government for Governmental purposes without the payment to me of any royalties thereon.

BACKGROUND OF THE INVENTION

1. Field of the Invention

This invention relates to a process and apparatus for the precision cutting of millimeter wavelength ferrite materials.

2. Description of the Prior Art

Ferrites, being brittle type ceramic materials, are susceptible to chipping, cracking and yielding otherwise rough surfaces upon cutting. Typical processing of ferrites utilizes conventional diamond saws for slicing and surface grinding wheels for grinding away ferrite material. These techniques are acceptable for microwave frequency applications where large ferrite pieces are used and where chipping and surface finish flaws will not degrade performance. Millimeter wave applications, however, utilize very small ferrite parts (dimensions typically less than 0.254 cm) hence rough surface finishes and chips in these ferrite parts cannot be tolerated when optimum performance is to be obtained.

SUMMARY OF THE INVENTION

A 5.71 cm diameter cutting blade mounted on a spindle is turned at a speed of 18,000 RPM. The ferrite to be cut is fed at a rate of from 0.0254 to 0.127 cm/sec. The blade is a resin bonded diamond. Cuts of from 0.102 to 0.356 cm deep are possible with this arrangement, which also minimizes chipping, cracking and surface roughness on the ferrite as well as minimizing blade wear.

DESCRIPTION OF THE PREFERRED EMBODIMENT

Figure 1:
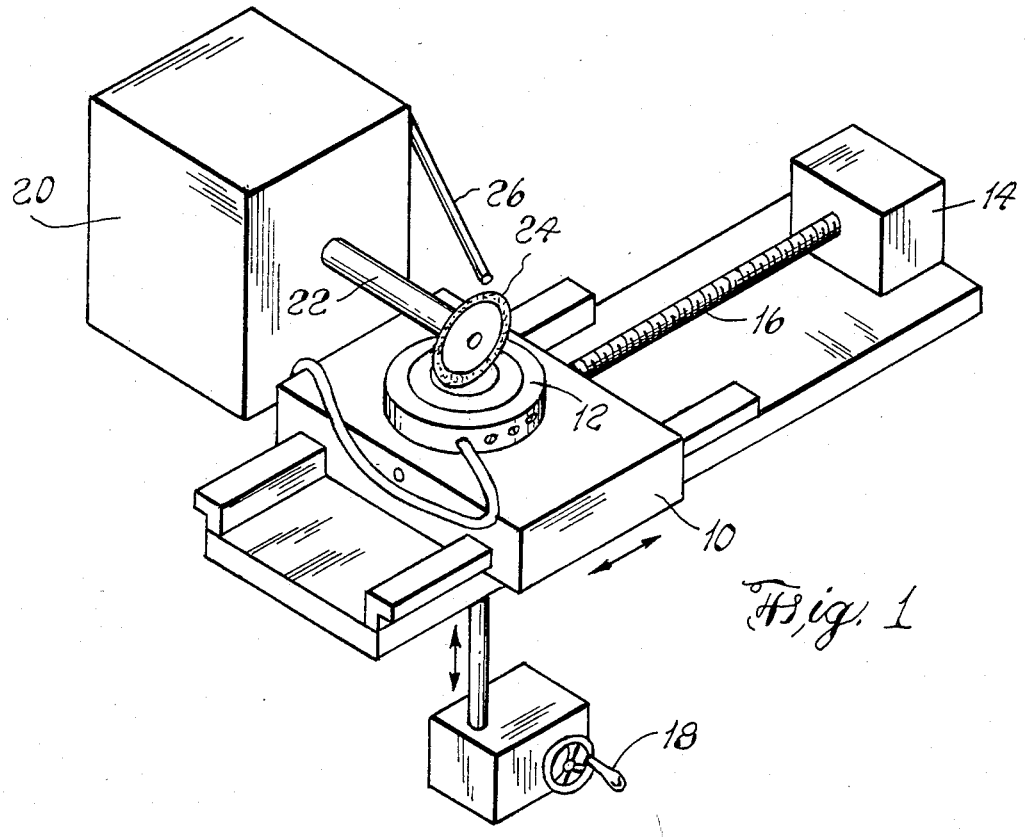
FIG. 1 is an schematic isometric representing a typical saw of the type used to carry out the invention.

Referring to FIG. 1, typical apparatus which may be employed in the invention is illustrated. Platform 10 serves as support for the ferrite material to be cut. Vacuum chuck 12, or an other holding device, well known in the art is used to secure the ferrite material to be cut on platform 10. Motor 14 turns worm 16 at a desired speed to move platform 10 laterally at a rate from 0.0254 to 0.127 cm/sec. This feed rate has been found to permit cutting of the ferrite material without causing chipping, cracking or unsuitably rough surface finishes on the ferrite. In addition, this feed rate does not overheat and thereby destroy the blade when making cuts from 0.102 up to 0.356 cm (0.040 to 0.140 inches) deep. Depth of cut is regulated by turning crank 18 to raise or lower platform 10.

Motor 20 turns spindle 22 at a speed of 18,000 RPMs which is employed with a cutting blade 24 having a diameter of 5.71 cm (2.25 inches) producing a peripheral speed of about 5400 cm/sec. This combination of spindle speed, blade diameter and platform feed rate no greater than 0.127 cm/sec has been experimentally determined to be optimum in providing superior ferrite cutting results with minimum blade wear while performing cuts of at least three times the depths possible with commercially available, unmodified, micro automation machines. Coolant (in this water has been used) is supplied through tube 26 to prevent overheating of the blade and ferrite.

Figure 2:
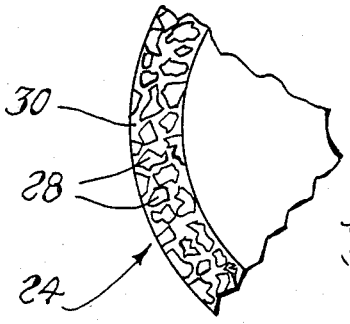
FIG. 2 is an elevation representing a portion of the saw blade.

Turning next to FIG. 2, a section of blade 24 of FIG. 1 is shown in greater detail. Diamond particles 28 are bonded in a matrix of resin material 30 forming the cutting edge of blade 24. Such blades are commercially available, for example, from Thermocarbon, Inc. of Casselberry, Fla.

Although a method and apparatus for precision cutting of millimeter wave ferrite materials has been illustrated and described, it will be apparent that changes and modifications can be made without departing from the spirit of the invention and the scope of the appended claims.

We claim:

1. A method of precision cutting of millimeter wave ferrite material comprising:

securing said ferrite material on a platform capable of controlled lateral movement; and moving said platform at a controlled feed rate of from 0.0254 to 0.127 cm/sec relative to a rotating transversely positioned circular saw;

said circular saw having a diameter and a spindle speed which combine to yield a cutting speed of 5400 cm/sec and having a blade fabricated of resin bonded diamond material.

2. A method of precision cutting of millimeter wave ferrite material in accordance with claim 1 wherein:

said circular saw is set to make a cut of a maximum depth of 0.356 cm.

3. A method of precision cutting of millimeter wave ferrite material in accordance with claim 1 wherein:

said spindle speed is 18,000 RPM.

4. A method of precision cutting of millimeter wave ferrite material in accordance with claim 1 wherein:

said ferrite material is secured on said platform with a vacuum chuck.

5. Apparatus for precision cutting of millimeter wave ferrite material comprising:

a circular saw blade;

a rotatable spindle for vertically mounting said circular saw blade;

motor means for rotating said spindle and said saw blade to provide a cutting speed of 5400 cm/sec.;

a horizontally positioned platform for securing the ferrite material to be cut thereon; and motor drive means for moving said platform and ferrite material laterally at a controlled feed rate of from 0.0254 to 0.127 cm/sec across the path of said saw blade, said saw blade being fabricated of a resin bonded diamond material.

6. Apparatus for precision cutting of millimeter wave ferrite material in accordance with claim 5 further including:

means for applying a coolant to said blade.

7. Apparatus for precision cutting of millimeter wave ferrite material in accordance with claim 5 further including:

a vacuum chuck for securing said ferrite material to said platform; and means for adjusting the height of said platform relative to said circular saw blade to provide a cut in said ferrite material up to a maximum depth of 0.356 cm.

* * * * *